US007392816B2

(12) United States Patent
Porter et al.

(10) Patent No.: US 7,392,816 B2
(45) Date of Patent: Jul. 1, 2008

(54) ADJUSTABLE SHADE-PROVIDING BUILDING STRUCTURE

(76) Inventors: Andrew H. Porter, 11900 Brownberry Dr., Lowell, MI (US) 49331; William H. Porter, P.O. Box 249, Saugatuck, MI (US) 49453

( * ) Notice: Subject to any disclaimer, the term of this patent is extended or adjusted under 35 U.S.C. 154(b) by 129 days.

(21) Appl. No.: 11/242,532

(22) Filed: Oct. 3, 2005

(65) Prior Publication Data

US 2007/0074461 A1 Apr. 5, 2007

(51) Int. Cl.
*E04H 15/34* (2006.01)

(52) U.S. Cl. ..... 135/123; 135/121; 135/122; 135/20.1; 135/23; 135/117; 135/15.1; 135/90; 135/98

(58) Field of Classification Search ..... 135/121, 135/122, 20.1, 23, 123, 117, 15.1, 90, 98
See application file for complete search history.

(56) References Cited

U.S. PATENT DOCUMENTS

| | | | | |
|---|---|---|---|---|
| 200,945 | A | 3/1878 | Smith | |
| 2,528,578 | A | 11/1950 | Clapper | |
| 2,547,896 | A | 4/1951 | Wellen | |
| 2,605,778 | A | 8/1952 | Clapper | |
| 2,707,476 | A | 5/1955 | Clemens | |
| 2,764,993 | A | 10/1956 | Wallace et al. | |
| 2,825,352 | A | 3/1958 | Lemen | |
| 2,845,078 | A * | 7/1958 | Singleton | 135/121 |
| 2,905,187 | A | 9/1959 | Croce | |
| 3,120,238 | A | 2/1964 | Glatz | |
| 3,383,814 | A | 5/1968 | Rowe | |
| 3,486,514 | A | 12/1969 | Prescott | |
| 3,566,420 | A | 3/1971 | Peterson et al. | |
| 4,295,481 | A | 10/1981 | Gee | |
| 4,319,600 | A | 3/1982 | Roche | |
| 4,586,525 | A | 5/1986 | Glatz et al. | |
| 4,622,987 | A | 11/1986 | Redl et al. | |
| 4,886,084 | A | 12/1989 | Lawrence et al. | |
| 5,020,557 | A | 6/1991 | Apple | |
| 5,116,258 | A | 5/1992 | Vennik | |
| 5,211,172 | A | 5/1993 | McGuane et al. | |
| 5,339,847 | A | 8/1994 | Kanter et al. | |
| 5,499,644 | A | 3/1996 | Geniele | |
| 5,555,903 | A * | 9/1996 | Rizzotti | 135/16 |
| 5,642,747 | A * | 7/1997 | Rizzotti | 135/16 |
| 5,735,302 | A | 4/1998 | Saliva | |
| 5,752,537 | A | 5/1998 | Kranzler | |
| 5,785,069 | A | 7/1998 | Glatz | |

(Continued)

*Primary Examiner*—Jeanette Chapman
*Assistant Examiner*—Daniel Kenny
(74) *Attorney, Agent, or Firm*—Price, Heneveld, Cooper, DeWitt & Litton LLP

(57) ABSTRACT

A shade structure includes a vertical column and a roof having a cover, a framework supporting the cover, and a mount attached for rotational adjustment to a top of the column and supporting the roof on the column. The framework includes a triangularly-shaped main beam arrangement comprising a plurality of beams secured together to form a triangle that lies in a vertical plane and that defines a peak and opposing first corners, with the mount being located between the peak and one of the opposing corners. The framework further includes a pair of transverse beams and a bracing beam secured to the triangular main beam arrangement that define opposing second corners. By this arrangement, an adjustable shade structure is provided that is able to withstand over 40 mph wind loads.

22 Claims, 5 Drawing Sheets

U.S. PATENT DOCUMENTS

| | | | |
|---|---|---|---|
| 5,937,882 | A | 8/1999 | Harbaugh |
| 5,943,709 | A | 8/1999 | Chiu |
| 5,947,139 | A | 9/1999 | Lebrecht |
| 6,079,059 | A | 6/2000 | Girerd |
| 6,250,322 | B1 | 6/2001 | Porter |
| 6,286,268 | B1 | 9/2001 | Pena |
| 6,305,394 | B1 | 10/2001 | Reese |
| 6,321,763 | B1 | 11/2001 | Ma |
| 6,371,139 | B1 | 4/2002 | Simchori |
| 6,412,506 | B1 | 7/2002 | Reese |
| 6,478,037 | B2 | 11/2002 | Tung |
| 6,575,183 | B2 | 6/2003 | Tung |
| 6,588,438 | B1 | 7/2003 | Steiner |
| 6,607,002 | B2 | 8/2003 | Reese |
| 6,637,717 | B2 | 10/2003 | Li |
| 6,692,135 | B2 | 2/2004 | Li |
| 6,718,566 | B1 | 4/2004 | Wilson |
| 6,725,870 | B1 | 4/2004 | Lo |
| 2002/0023672 | A1 | 2/2002 | Reese |
| 2002/0121297 | A1 | 9/2002 | Li et al. |
| 2003/0062073 | A1 | 4/2003 | Tung |
| 2004/0069333 | A1 | 4/2004 | Ma |
| 2004/0154653 | A1 | 8/2004 | Brutsaert |
| 2004/0177871 | A1 | 9/2004 | Harbaugh |

* cited by examiner

ADJUSTABLE SHADE-PROVIDING BUILDING STRUCTURE

BACKGROUND

The present invention relates to an adjustable shade-providing building structure, and more particularly relates to a structure configured to provide adjustable shading in an outdoor open environment, but that is also configured to meet many building codes and to provide greater durability and permanency than umbrella furniture systems and traditional shading systems that will not withstand wind loads.

Many establishments require (or desire) shading structures to facilitate and promote outdoor activities. For example, furniture with umbrellas are often used in outdoor restaurants, picnic areas and beaches to provide shade from the sun while allowing users to enjoy the sun and outdoor areas. However, the umbrellas used in furniture are typically relatively lightweight and not intended to be left outside for extended periods of time. Nor are they made with sufficient structure to withstand high wind, intense rain or other harsh weather conditions. Nor are they made to meet building codes.

There are also umbrella structures and covers that are intended for more permanent installation and use, such as structures for covering hot tubs, pools, and the like. However, where they are intended to be exposed to the environment for longer periods of time, they are typically intended to be latched down with multiple latches and/or anchored with tie-downs. Also, many are complex to assemble and expensive to erect and/or install.

There are also awnings and fabric-covered "porch-type" systems. However, they are not free-standing, but instead require the presence of a building wall for their basic anchoring and support. Further, though these systems are sometimes extendable, they are not adjustable around a specific center location in order to continue to provide shading in the center location as the sun moves across the sky. Instead, they basically must be big enough or low enough so that the desired area always has some shade. Also, like umbrellas, many of these systems are not intended to withstand high wind, intense rain, or other harsh weather conditions. Instead, they are intended to be retracted and/or taken down during any significant wind and weather.

We, the inventors, have found a continued unmet need for an adjustable structure configured to provide adjustable free-standing shading, including shading that an "untrained" user can adjust, but that is also configured to meet building codes and to provide greater durability and permanency than traditional umbrella and awning systems. In particular, the present known prior art shading systems do not provide a roof-supporting structure sufficient to withstand high wind (such as 90 mph wind loads) where the structure is also adjustable to maintain shading in a particular area as the sun moves across the sky. Further, the known shading systems that are more durable tend to lack style and elegance. Further, they include multiple components, making them expensive to purchase, cumbersome to assemble, expensive to erect and/or build, and difficult and expensive to repair.

In addition, there is a need to combine basic structural building technology with shading technology in a manner that provides flexibility in the design, styling, and appearance. It is desirable to provide a building structure that is flexible in terms of size, shape, and simplicity of installation and repair.

Another need is that common umbrella systems have a pole in the center. With a pole in the center, a table below is impossible unless it is built around the column. It is desirable to have an offset column umbrella that allows for any table and column arrangement be placed directly below the center of shade when the sun is overhead.

Thus, a system having the aforementioned advantages and solving the aforementioned problems is desired.

SUMMARY OF THE PRESENT INVENTION

In one aspect of the present invention, a shade structure includes a vertical column and a roof. The roof includes a cover, a framework supporting the cover, and a mount attached to a top of the column and supporting the roof for rotation to different shade positions around the column including immediately adjacent the column. The mount is located inside a perimeter defined by the cover but is spaced horizontally from a center of the cover, so that the roof can be adjusted by rotation to the different shade positions to selectively provide shade around and immediately adjacent the column throughout a sunny day.

In another aspect of the present invention, a shade structure includes a vertical column and a roof having a cover, a framework, and a mount attached to a top of the column and supporting the roof on the column. The framework includes a triangular main beam arrangement comprising a plurality of beams secured together to form a triangular structure that lies in a vertical plane and that defines a peak and opposing first corners, with the mount being located between the peak and one of the opposing corners. The framework further includes at least one transverse beam secured to the triangular main beam arrangement and that defines opposing second corners.

In another aspect of the present invention, a shade structure includes a vertical column and a roof including a cover, a framework, and a mount attached to a top of the column and supporting the roof on the column. The mount includes a section engaging the column, and the framework includes first and second beams secured to and extending from the column-engaging section and further includes a third beam secured to the first and second beams but not secured to the column-engaging section. The first beam includes a first end and a second end, and one of the second and third beams includes a third end. The first and third ends define opposing corners of the roof and the second end defines a peak of the roof, with the column-engaging section being located between and below the first and second ends of the first beam at a location offset from the peak and from a perimeter of the roof.

In still another aspect of the present invention, a shade structure includes a vertical column and a roof for the structure. The roof includes a cover, a framework with at least one structural beam, and a mount attached to a top of the column and supporting the roof on the column. The mount includes a section engaging the column, with the beam being secured to the column-engaging section. The beam includes a first end section extending in a first direction from the column-engaging section to define a first corner of the roof and further includes a second end section extending in an opposite second direction and at an angle from the column-engaging section to define a peak of the roof, with the mount being between the first corner and the peak.

In yet another aspect of the present invention, a shade structure includes a column, a roof-supporting framework supported by the column, and a cover. The cover is made of sheet material and covers the framework for providing shade. The framework includes a mount engaging a top of the column and further includes a beam arrangement supported by the mount. The beam arrangement has first and second beams defining first opposing corners on opposite sides of the column, and also has third and fourth beams defining second opposing corners on opposite sides of the column, and still further has at least one stabilizer fifth beam extending between and connected to the third and fourth beams and also connected to another part of the beam arrangement for stabilizing the third and fourth arms relative to the mount.

In yet another aspect of the present invention, a shade structure includes a column, a plurality of beams secured to a top of the column and forming a non-folding framework, and a cover. The beams are positioned asymmetrically about the column and include a first pair of beams that extend in opposite directions from the column to define a vertical plane with the column and further include at least two laterally-extending beams that extend on opposite sides of the vertical plane. The first pair of beams and the laterally-extending beams define a plurality of corners and also define a peak, with the peak and the corners all being spaced from the column when the shade structure is viewed from above. The cover is made of sheet material and covers the beams.

In another aspect of the present invention, a shade structure includes a column, a roof-supporting framework having a matrix of interconnected beams supported on the column, and a sheet cover supported by and covering the framework. The matrix of interconnected beams forms at least four corners, a peak offset from a center of the at least four corners, and includes a mount engaging the column at a location offset from the center and offset inboard from the at least four corners.

An object of the present invention is to provide a shade structure that is durable, robust, and that will pass many building codes.

Another object is to provide an adjustable shade structure that is able to withstand 40 mph or even up to 90 mph winds.

Another object is to provide an adjustable shade structure that is flexible in shape and aesthetically appealing, visually attractive and mentally stimulating.

Another object is to provide an adjustable shade structure that is heavy duty and robust, but that is intuitively adjustable to unskilled users.

Another object is to provide an adjustable shade structure that is relatively easy to construct/erect without high capital investment and skilled labor.

Another object is to provide an adjustable shade structure that includes components that can be removed, replaced, and/or fixed without heavy equipment.

Another object is to provide an adjustable shade structure that is able to provide shade to several people at a time, despite movement of the sun across the sky.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
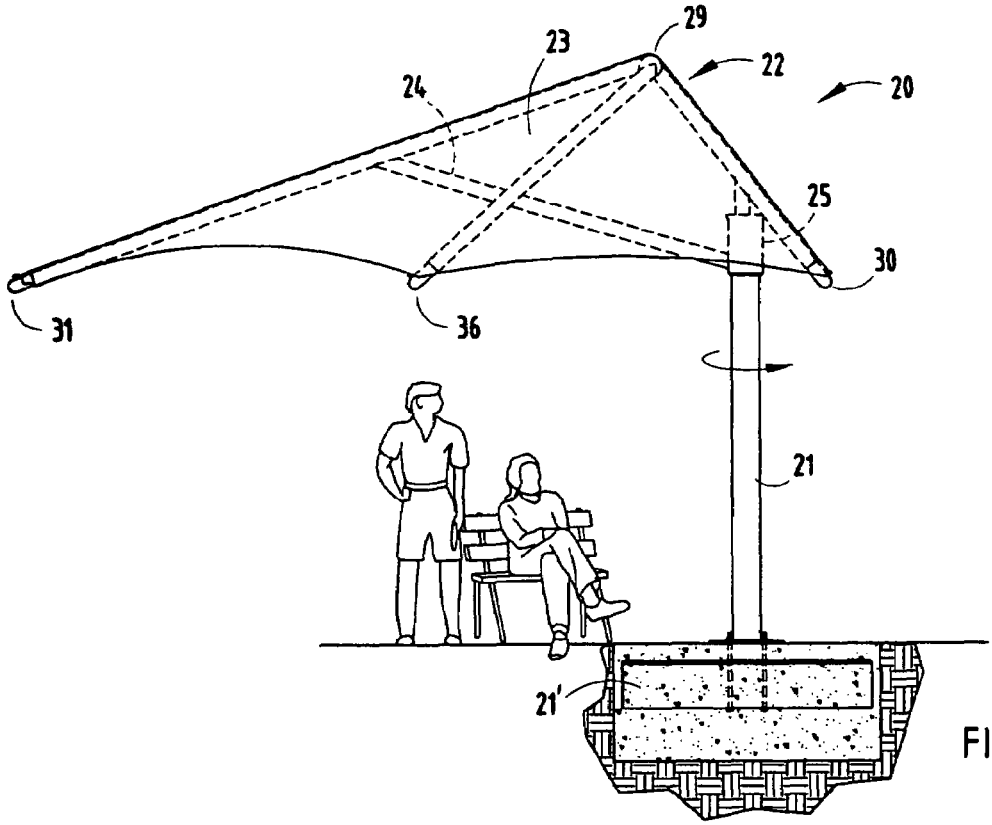
FIGS. 1-2 are side and perspective views of a shade structure embodying the present invention.
Figure 2:
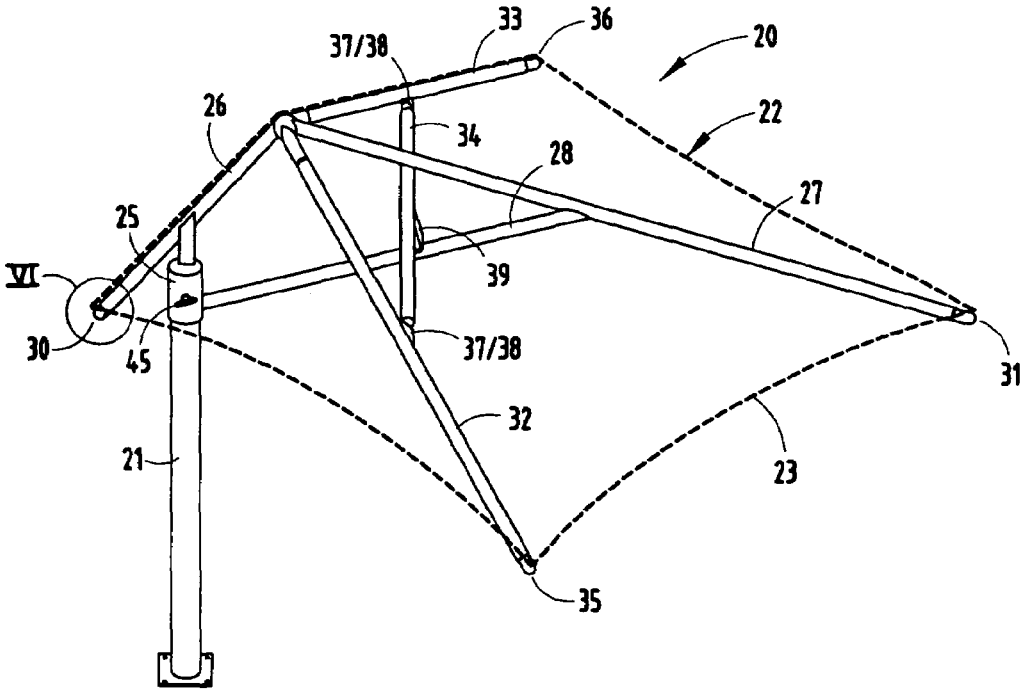
Figure 4:
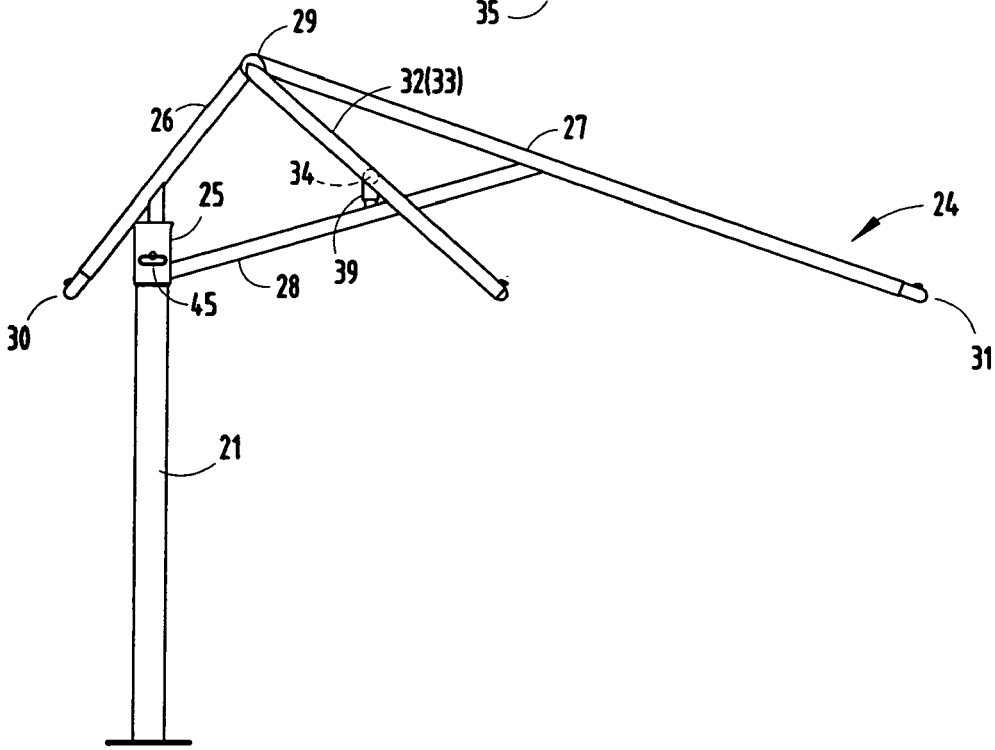
Figure 5:
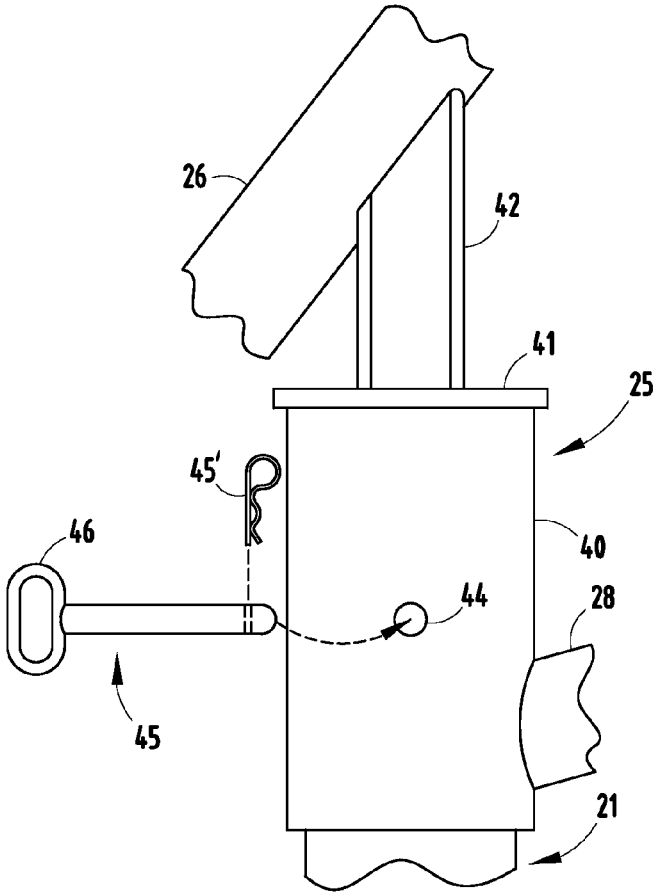
FIG. 5 is a side view of the mount structure shown in FIG. 4.
Figure 5A:
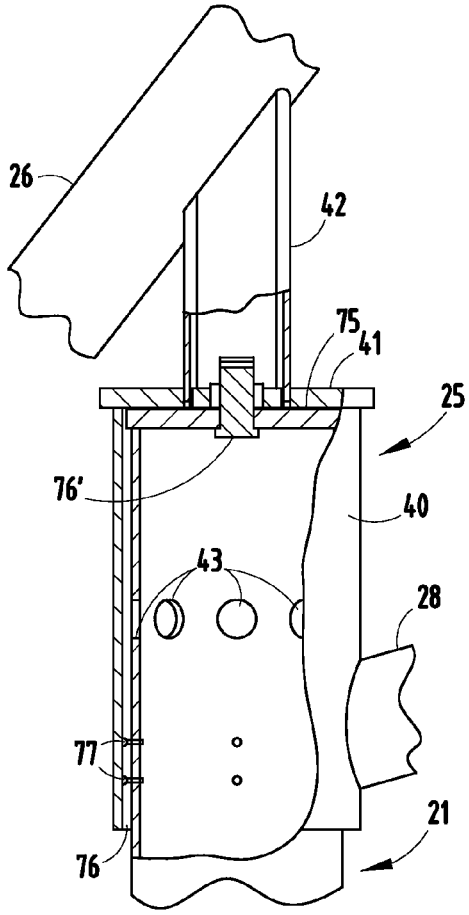
FIG. 5A is a cross section similar to FIG. 5 but showing internal components.
Figure 9:
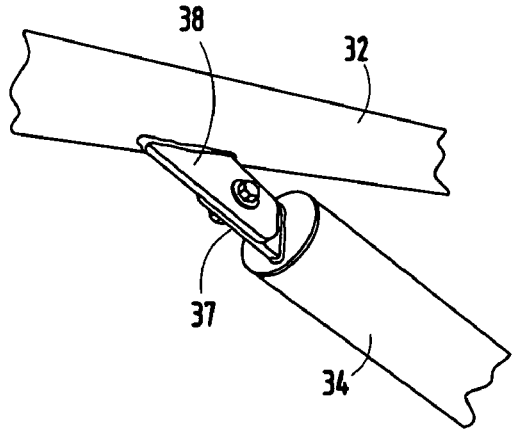
FIGS. 9-10 are fragmentary perspective views of the interconnection of the cross beam in FIG. 2 to other beams in the beam arrangement of the roof-supporting structure.
Figure 10:
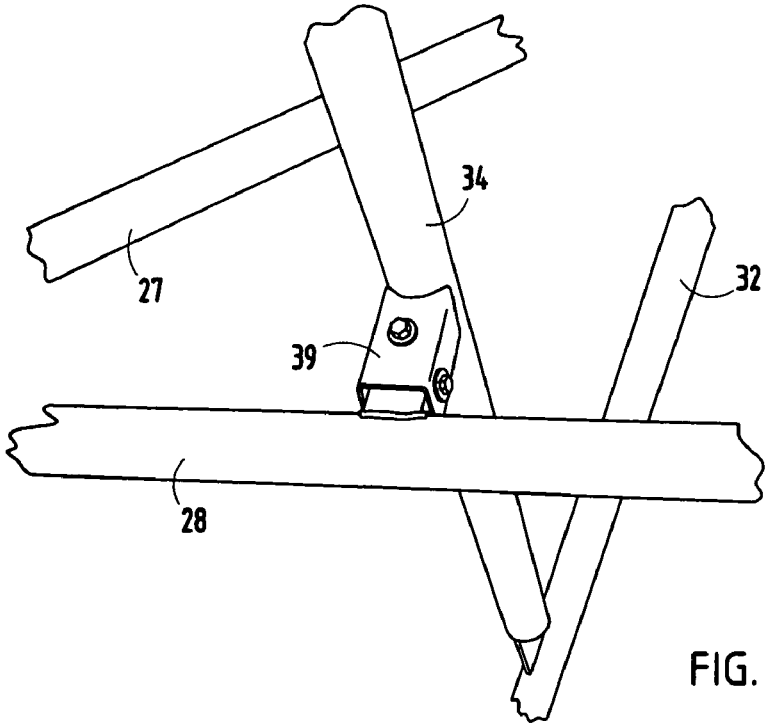

A shade structure 20 (FIG. 1-2) includes a vertical column 21 and a roof 22 having a cover 23, a framework 24 supporting the cover 23, and a mount 25 attached to a top of the column 21 and rotatably supporting the roof 22 on the column 21. The framework 24 includes a triangularly-shaped main beam arrangement (FIG. 4) comprising a plurality of beams 26-28 secured together to form a triangular that lies in a vertical plane and that defines a peak 29 and opposing first corners 30 and 31, with the mount 25 being located between the peak 29 and one of the opposing corners 30 and 31. The framework 24 further includes a pair of transverse beams 32 and 33, stabilized by a transverse bracing beam 34. The inner ends of the beams 32 and 33 are secured to the triangular main beam arrangement at the peak and include ends that define opposing outer (lateral) second corners 35 and 36 of the shading arrangement. The bracing beam 34 (FIGS. 9-10) includes longitudinally-extending end flanges 37 bolted to a mating flange 38 on the beams 32 and 33. The bracing beam 34 also includes a mid-located "box" flange 39 bolted to a mating flange on the beam 28. It is noted that the peak 29 is formed by a rounded ball-like structural component that forms a rounded peak . . . instead of a pointed peak. This allows the cover 23 to move and give, and better distributes stress and thus reduces a tendency to tear at the peak. The inner ends of beams 35 and 36 are secured to the peak 29. In the illustrated arrangement, this connection is facilitated by tube stubs 29' extending from the ball-like structural component forming the peak 29, which telescopingly receive the inner ends of the beams 32 and 33. Notably, the angle of the tube stubs 29' set the angle of the beams 32 and 33 relative to the beams 26-28. The mount 25 rotates on the top of column 21 but can be fixed at selected positions by a lock pin 45 (FIGS. 2 and 5). By this arrangement, the shade structure 20 is angularly adjustable by rotation around the column 21, yet due in large part to the structural integrity of the framework 24 and column 21, is able to meet building codes and also withstand high winds, such as up to 40 mph or even 90 mph wind loads. The shade structure 20 shades an area including the column 21, which creates a highly desirable shaded area immediately adjacent and around the column 21.

The column 21 is a free-standing single vertical column supported in a foundation 21'. The foundation is of standard construction. The illustrated foundation is of a type permitting the column to be bolted down to the foundation, such as is often used in poles for lighting for parking lots and similar situations. However, it is contemplated that other foundations can be used, such as a foundation where the column itself is permanently set into the concrete. The illustrated column 21 is a round tubular shape. It is contemplated that the top of column 21 will be made sufficiently accurately round and smooth for rotatably supporting the mount 25, as discussed below. However, the top could be machined or reformed, or could have material added to it or removed from it in order to properly form the top for rotational support of the mount 25. The illustrated column 21 top can be located at any height desired, such as for supporting the roof 22 high enough for people to stand under without interference. The column 21 can be made high and large enough to shade a platform, such as a lifeguard station or a spectator/viewing platform.

The illustrated mount 25 (FIG. 5) is set onto the top of the column 21, where it rotatably supports the roof 22 on the column 21. The mount 25 includes a cylindrical tube section 40, a top plate 41, and a top tubular extension 42. A bearing plate 75 is positioned at a top of the cylindrical tube section 40 under the top plate 41, for engaging the top of the column 21 for rotatably supporting the roof 22. A pin 76' extends from a top of the column 21 through bearing 75 and top plate 41 and serves to retain the mount 25 to a top of the column 21, as well as serving as an axle for rotation of the roof 22 on the column 21. A plurality of bearing pads 76 (such as three or more) are attached to a top of the column 21, such as by recessed screws 77 for slidably supporting the mount tube section 40 for rotation. A plurality of holes 43 are formed around the top of the column 21, such as every 30 degrees, and a pair of aligned holes 44 (FIG. 5) are positioned in the mount 25. By rotating the mount 25, the holes 44 can be selectively aligned with a pair of the holes 43. A lock pin 45 includes a shaft that fits through the aligned holes 43-44 to fix the angular position of the mount 25 (and roof 22) on the column 21, and a key 45' for securing it in place. The lock pin 45 includes a loop handle 46 that limits insertion of the anchor pin 45 into the holes 44-45, and also that provides a large place for a person to grip and pull the anchor pin 45.

It is contemplated that a variety of different bearing arrangement for mount 25 could be used. For example, the bearing arrangement can include a top bearing to take vertical loads and also bottom bearings spaced around the top of the column to facilitate rotation and to take horizontal/torsional loads. As noted above, the illustrated arrangement includes a top bearing pad 41 located on a top surface of the column 21, and also additional bearing pads 76 can be positioned around the mount 25, such as three side-located bearing pads spaced at 120 degrees . . . or five side-located bearing pads spaced at 72 degrees.

Figure 7:
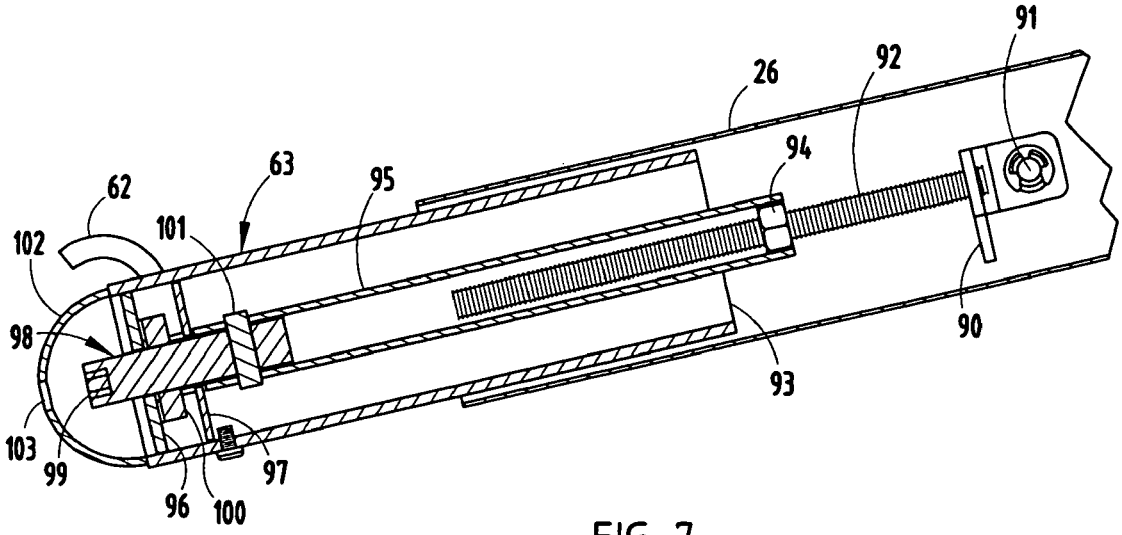
FIG. 7 is a longitudinal cross section showing the internal structure in FIG. 6.
Figure 8:
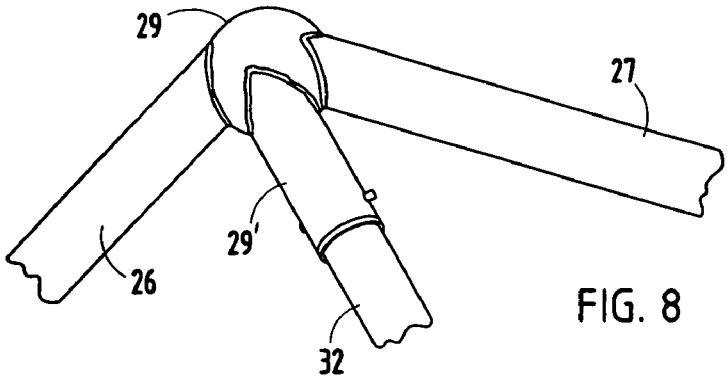
FIG. 8 is a side view of the peak formed by the beams in FIG. 2.

Beam 26 is welded to a top of mount 25 at angle (FIG. 5), and includes a first leg that defines peak 29 and an outer leg that defines corner 30. The outer leg has an extendable section with hook for engaging a perimeter cable 61 (FIG. 7). Beam 27 extends from a lower portion of the mount 25 for supporting beam 27. Beam 27 also has an extendable section with hook for engaging the perimeter cable 61. Notably, ends of illustrated beams 32 and 33 are non-adjustable (but could be made adjustable if needed).

Figure 6:
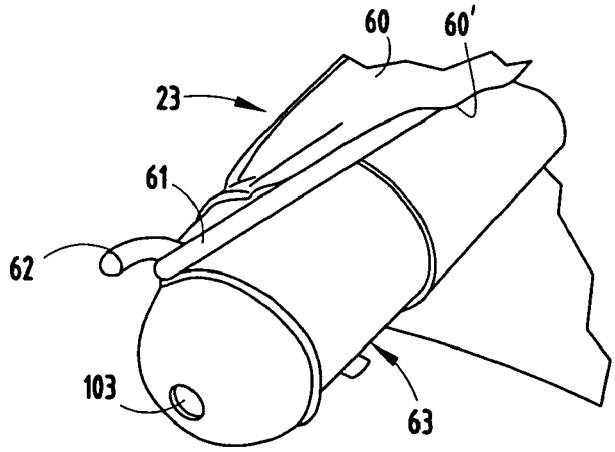
FIG. 6 is an enlarged cross sectional view of the end identified by circle VI in FIG. 2.

The present cover 23 (FIG. 6) is a fabric material 60 with a perimeter cable 61 retained along its perimeter, such as under a folded back perimeter flap 60' of the fabric material. The present cover 23 is secured to its supporting roof framework 24 by hooks 62 (FIG. 7) on ends of the framework beams forming the corners of the roof. The hooks 62 engage exposed portions of the cable 61 at corners of the cover 23. Two of the illustrated beams (i.e., beams 26 and 28) include telescopingly extendable tubular end sections 63 that are extendable by operation of a forced extension device as discussed below.

The forced extension device (also called a "tensioner" herein) and related components are perhaps best shown in FIG. 7. A U-shaped clevis-like anchor bracket 90 is supported in a tubular end of the beam 26 (and another one in an end of the beam 27) by a removable pin 91, the pin extending through opposing ends of the bracket and through opposing walls of the beam. (By removing pin 91, the entire forced extension device and tubular section 63 can be removed for repair or replacement.) A threaded rod 92 is fixed to the bracket 90 and extends longitudinally toward an open end of the beam 26. The tubular section 63 includes an open end 93. An internal pipe section 95 is axially extended onto the threaded rod 92, and includes a nut 94 welded to its inner end that threadably engages the threaded rod. The pipe section 95 further extends toward the outer end of the tubular section 63 along an axial centerline of the beam 26, with a free end of the threaded rod 92 being located within the pipe section 95. Two outer plates 96 and 97 are welded to the outer end of the tubular section 63. A stud 98 extends through the outer plates 96 and 97, and includes a hex head 99 positioned outside of the outer plate 96, a washer 100 positioned between the plates 96 and 97, and a projecting shaft 101 positioned within and fixed (e.g., by welding) to the outer end of the pipe section 95. A semi-spherical end cap 102 is attached to the end of the beam 26, and includes a centered aperture 103 that permits an adjustment tool (such as a drill with a socket thereon) to access the head 99 for rotating the drive components 98/95/94 of the forced extension device as a unit. By rotating the drive components 98/95/94, the nut 94 walks along the threads of the threaded rod 93, causing the tubular section 63 to telescopingly extend (or retract) on beam 26. This in turn causes the hook 62 to tension (or de-tension) the cable that retains the cover on the roof frame structure. Notably, the access aperture 103 reduces access to the head 99, thus limiting unauthorized adjustment of the force extension device.

It is noted that the concept of beams with telescopingly extendable end sections is described in Porter U.S. Pat. No. 6,874,518 B2 (filed Dec. 3, 2002, issued Apr. 5, 2005), and the reader is referred to this patent if additional detailed discussion and/or an understanding of alternative designs is desired. The entire teachings and disclosure in U.S. Pat. No. 6,874,518 are incorporated herein in their entirety. It is noted that the alternative telescoping beam constructions and cover constructions shown in U.S. Pat. No. 6,874,518 could be adapted for use in the present structure 20. Nonetheless, the present description and disclosure in the drawings is believed sufficient for an understanding of the present inventive concepts.

Figure 3:
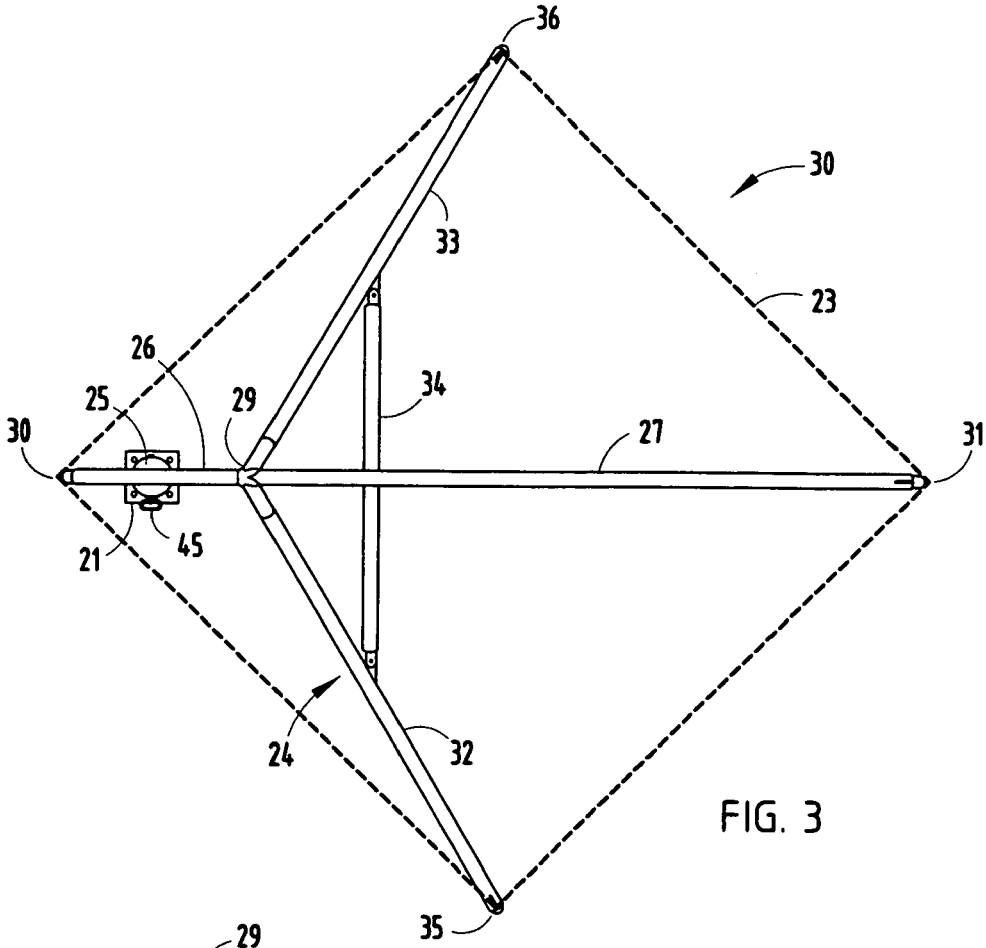
FIGS. 3-4 are top and side views of FIG. 2.

The illustrated cover 23 is diamond-shaped (FIG. 3), with its peak 29 offset from a center of the diamond and also offset from and inboard of the corners. The framework 24 is a quality building structure and stably supports the cover 23, such that the present arrangement can withstand 40 mph up to 90 mph winds or more. However, the cover 23 is replaceable by unskilled labor by manipulation of the threaded shaft member 64, such that the present cover can be relatively easily replaced. This is believed to be highly unusual in a building-type structure, and is believed to contribute to the present novelty. Also, the framework 24 can be lifted off of the column 21 and replaced (such as to provide a framework with a different size, shape, or color) or repaired (such as if unexpectedly high winds or weather cause damage to the framework 21), or for refurbishing after an extended period of time. This reparability also is unusual in a building-type structure, and is believed to contribute to the present novelty.

The framework 24 is structural and engineered to meet building codes for structure, durability against high wind, severe weather, and fire rating. As noted above, the framework 24 includes a rigid triangularly-shaped main beam arrangement comprising a plurality of beams 26-28 secured together to form a triangular that lies in a vertical plane and that defines a peak 29 and opposing first corners 30 and 31. Mount 25 is located in an offset position between the peak 29 and one of the opposing corners 30 and 31.

The peak is offset from the center of the cover . . . providing a unique tent-like diamond-shaped appearance with curved edges that is aesthetically unique in a way that encourages imagination and heightens interest of users and enjoyment of the outdoors. The fabric can be made colorful and the framework and column can be powder coated or painted to match. At the same time, the design is functional in that rain is directed at angles away from the peak, as well as wind being deflected at an angle, which reduces stress and strain during extreme weather conditions.

By this arrangement, the shade structure 20 is a permanent yet adjustable building structure that, due in large part to the structural integrity of the framework 24, is able to withstand 40 mph wind loads, and even up to 90 mph wind loads.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A shade structure comprising:

a vertical column; and a roof including a cover defining an off-center single-point peak, a framework located under and supporting the cover, and a single mount located under the cover and rotatably attached to a top of the column and supporting the roof for rotation to different shade positions around the colunm including immediately adjacent the column, the mount being located inside a perimeter defined by the cover but spaced horizontally from the peak and from a center of the cover, so that the roof can be rotationally adjusted to the different shade positions to selectively provide shade around and immediately adjacent the column throughout a sunny day;

wherein the cover includes a cable extending around the perimeter, and wherein the framework includes beams with hooks on ends of the beams for engaging the cable to retain the cover to the framework, and further including a tensioner on at least one of the beams that is extendable in a direction parallel the one beam to positively engage and retain the cable under tension on the framework.

2. The shade structure defined in claim 1, wherein the framework includes beams secured together to withstand the force of over 40 mph winds.

3. The shade structure defined in claim 2, wherein the framework includes a matrix of interconnected tubular beams.

4. The shade structure defined in claim 3, wherein the cover includes a four-sided perimeter.

5. The shade structure defined in claim 1, wherein the mount includes a tube section shaped to fit onto and rotatably engage the top of the column.

6. A shade structure comprising:

a vertical column; and a roof including a cover defining an off-center single-point peak, a framework located under and supporting the cover, and a single mount located under the cover and rotatably attached to a top of the colunm and supporting the roof for rotation to different shade positions around the colunm including immediately adjacent the column, the mount being located inside a perimeter defined by the cover but spaced horizontally from the peak and from a center of the cover, so that the roof can be rotationally adjusted to the different shade positions to selectively provide shade around and immediately adjacent the column throughout a sunny day; wherein the mount includes a tube section shaped to fit onto and rotatably engage the top of the column; wherein the framework includes first and second beams fixed to and extending from the mount at different height locations.

7. The shade structure defined in claim 6, wherein the framework includes a third beam secured to and extending from an inboard end of the first beam and that defines a peak with the first beam.

8. The shade structure defined in claim 7, including fourth and fifth beams connected to the peak and extending in a lateral direction from the peak, the first, third, fourth and fifth beams forming corners on the cover.

9. A shade structure comprising:

a vertical column; and a roof including a cover, a framework supporting the cover, and a mount attached to a top of the column and supporting the roof for rotation to different shade positions around the colunm including immediately adjacent the column, the mount being located inside a perimeter defined by the cover but spaced horizontally from a center of the cover, so that the roof can be rotationally adjusted to the different shade positions to selectively provide shade around and immediately adjacent the column throughout a sunny day;

wherein the mount includes a tube section shaped to fit onto and rotatably engage the top of the column; wherein the framework includes first and second beams fixed to and extending from the mount at different height locations;

wherein the framework includes a third beam secured to and extending from an inboard end of the first beam and that defines a peak with the first beam;

including fourth and fifth beams connected to the peak and extending in a lateral direction from the peak, the first, third, fourth and fifth beams forming corners on the cover; and a transverse beam connecting the fourth and fifth beams at a location spaced from the peak to stabilize the fourth and fifth beams on the framework.

10. A shade structure comprising:

a vertical column; and a roof including a cover defining an off-center single-point peak, a framework located under and supporting the cover, and a single mount located under the cover and rotatably attached to a top of the colunm and supporting the roof for rotation to different shade positions around the colunm including immediately adjacent the column, the mount being located inside a perimeter defined by the cover but spaced horizontally from the peak and from a center of the cover, so that the roof can be rotationally adjusted to the different shade positions to selectively provide shade around and immediately adjacent the column throughout a sunny day; including a locking mechanism on the mount and on the top of the column that is selectively engageable to hold the mount in a selected angular position on the column.

11. The shade structure defined in claim 10, wherein the locking mechanism includes a locking pin and further includes a plurality of holes in the mount and in the top of the column that can be selectively aligned at different angular positions of the mount to receive the locking pin.

12. The shade structure defined in claim 1, wherein the beams include opposing beams, each having one of the tensioners.

13. The shade structure defined in claim 1, A shade structure comprising:

a vertical column; and a roof including a cover defining an off-center single-point peak, a framework located under and supporting the cover, and a single mount located under the cover and rotatably attached to a top of the colunm and supporting the roof for rotation to different shade positions around the colunm including immediately adjacent the column, the mount being located inside a perimeter defined by the cover but spaced horizontally from the peak and from a center of the cover, so that the roof can be rotationally adjusted to the different shade positions to selectively provide shade around and immediately adjacent the column throughout a sunny day; wherein the framework includes first, second, and third beams secured rigidly together to form a triangular arrangement defining a vertical plane, including opposing corners and a peak.

14. A shade structure comprising:

a vertical column; and a roof including a cover defining an off-center single-point peak, a framework located under and supporting the cover, and a single mount located under the cover and rotatably attached to a top of the colunm and supporting the roof for rotation to different shade positions around the colunm including immediately adjacent the column, the mount being located inside a perimeter defined by the cover but spaced horizontally from the peak and from a center of the cover, so that the roof can be rotationally adjusted to the different shade positions to selectively provide shade around and immediately adjacent the column throughout a sunny day; including a rotation lock mechanism for locking the mount on the top of the column in different angular positions.

15. The shade structure defined in claim 1, wherein the cover is a fabric material.

16. The shade structure defined in claim 15, wherein the framework includes a tensioner for tensioning a perimeter of the cover to retain the cover to the framework.

17. The shade structure defined in claim 15, including a permanent foundation, the column being secured to the foundation to form a building structure.

18. The shade structure defined in claim 1, including bearing material positioned on and around the colunm for rotatably supporting the mount on the column.

19. The shade structure defined in claim 18, wherein the bearing material includes at least one top pad and at least three side pads engaging the top of the colunm and an inside of the mount.

20. A shade structure comprising:

a vertical column; and a roof including a cover, a framework, and a mount rotatably attached to a top of the column and supporting the roof on the column, the framework including a triangular main beam arrangement comprising a plurality of beams secured together to form a triangular structure lying in a first vertical plane and defining a single-point peak offset from a center of the roof and opposing first corners, with the mount being located under the cover and between the peak and one of the opposing first corners, the framework further including at least one transverse beam secured to the triangular main beam arrangement and extending laterally that defines opposing second corners, the cover being symmetrically bisected by the first vertical plane but being asymmetrical when bisected by a second vertical plane passing through the second corners, at least two of the beams being fixed to and extending from the mount at different height locations.

21. The shade structure defined in claim 20, wherein the at least one transverse beam includes a pair of transverse beams and a bracing beam secured to the triangular main beam arrangement and that define opposing second corners.

22. A shade structure comprising:

an overhead metal frame;

fabric stretched over an outside of the frame with the frame being under the fabric, the overhead metal frame including at least one tensioning device for tensioning a cable extending around a perimeter of the fabric and retaining the fabric on the overhead metal frame;

an offset column mounted near but inside a perimeter of the overhead metal frame; and a single mount rotatably engaging a top of the colunm and defining a pivot joint that is the sole support that connects the colunm to the overhead metal frame so that the overhead metal frame and fabric can be rotated to provide shading to fixed objects therebelow as the sun moves across the sky, the mount including a tube section and a top plate rotatably engaging a top of the column, the overhead metal frame including at least two beams being fixed to and extending from the mount at different height locations.

* * * * *